United States Patent [19]

Ross

[11] 4,394,640

[45] Jul. 19, 1983

[54] SAFE MERGING SYSTEM USING SHORT PULSE SIGNAL REFLECTOMERTY

[75] Inventor: Gerald F. Ross, Lexington, Mass.

[73] Assignee: Sperry Corporation, New York, N.Y.

[21] Appl. No.: 236,504

[22] Filed: Feb. 20, 1981

[51] Int. Cl.[3] ..... G08G 1/12

[52] U.S. Cl. ..... 340/23; 340/47

[58] Field of Search ..... 340/47, 23, 38 R, 32; 343/112 CA, 112 D, 112 S, 112 TC

[56] References Cited

U.S. PATENT DOCUMENTS

| | | | |
|---|---|---|---|
| 2,685,068 | 7/1954 | Goubau | 333/240 |
| 3,582,626 | 6/1971 | Stansbury | 343/112 CA |
| 3,662,316 | 5/1972 | Robbins | 375/35 |
| 3,832,568 | 8/1974 | Wang | 307/106 |
| 3,971,990 | 7/1976 | Ross | 343/5 R |
| 3,979,749 | 9/1976 | Ross et al. | 343/13 R |
| 4,188,595 | 2/1980 | Cronson et al. | 333/240 |
| 4,254,418 | 3/1981 | Cronson et al. | 343/112 CA |

*Primary Examiner*—Glen R. Swann, III

*Attorney, Agent, or Firm*—Howard P. Terry; Seymour Levine

[57] ABSTRACT

Electromagnetic pulses of substantially nanosecond duration are transmitted from a merge location along transmission lines paralleling merging guideways to be incident to reflecting or repeating apparatus on vehicles approaching the merge. Coupling of the reflecting or repeating apparatus to the transmission line is such that sufficient electromagnetic energy is returned from the $n^{th}$ vehicle to the merge location for detection and processing thereafter. The returned signals are used to calculate, for each vehicle, the distance from the merge location and the approach speed.

8 Claims, 6 Drawing Figures

SAFE MERGING SYSTEM USING SHORT PULSE SIGNAL REFLECTOMERTY

BACKGROUND OF THE INVENTION

1. Field of the Invention

The invention pertains to vehicle traffic control and more particularly to the control of merging vehicles travelling along intersecting guideways.

2. Description of the Prior Art

Automated mass transit systems require devices for controlling the flow of traffic along the guideways of the system and for controlling traffic flow at a merge or intersection of two of these guideways. Traffic control along a guideway may be accomplished with the utilization of collision avoidance apparatus on-board each vehicle, such as the device disclosed by Cronson et al. in U.S. Pat. No. 4,254,418 issued Mar. 3, 1981 and assigned to the assignee of the present invention, which may be utilized to maintain minimum separation between vehicles in a guideway, thus avoiding collision and controlling the flow of traffic. This collision avoidance apparatus utilizes a short pulse transmitter and receiver on each vehicle that traverses the guideway. A short pulse is coupled from the transmitter to a transmission line, which parallels the guideway, for propagation forward of the vehicle. When the short pulse reaches a preceding vehicle it is reflected from a reflector positioned at the rear of the forward vehicle back towards the emitting vehicle where it is received and processed. Since reflections from a preceding vehicle are required, this apparatus cannot provide information for controlling the flow of vehicles approaching an intersection of two guideways or approaching a merge of two guideways to safely combine these vehicles into a single line of traffic.

SUMMARY OF THE INVENTION

A vehicular traffic control system for monitoring and controlling vehicles travelling on each of a multiplicity of merging guideways embodying the principles of the present invention may employ transmission lines positioned parallel to each guideway on which short electromagnetic pulses with durations in the order of 1 nanosecond may propagate. At the merge point of interest each transmission line is coupled, via a directional coupler and duplexer, to a short pulse transmitter and receiver. Short pulses from the transmitter are coupled via the duplexer and directional coupler to the transmission line to propagate towards vehicles approaching the merge. In one embodiment of the invention, reflectors positioned on each vehicle are coupled to the transmission line to reflect a portion of the pulse incident thereto back towards the merge while the remaining pulse energy propagates therepast to be incident to the reflectors on board trailing vehicles. The reflected pulses propagate back towards the merge and are coupled via the directional coupler and duplexer to a receiver wherein they are detected and coupled to a processor which determines the range (distance from the merge to the vehicle) and range rate (speed) of each of the vehicles approaching the merge. The range and range rate of the vehicles traversing each of the guideways is coupled to an approach control signal generator which generate vehicle control signals for transmission to all the vehicles approaching the merge.

In a second embodiment of the invention, a receiver and transmitter on each vehicle is coupled via a duplexer and a directional coupler to the transmission line paralleling the guideway. Portions of the signal energy propagating along the transmission line from the merge are coupled via the on-board directional coupler and the on-board duplexer to the on-board receiver for detection. The detected signal is utilized to activate the on-board transmitter which generates a short pulse in response thereto. This short pulse is coupled via the duplexer and directional coupler to the transmission line paralleling the guideway for propagation towards the merge. These repeated signals are coupled at the merge location to a receiver via a directional coupler and duplexer and processed to provide the vehicle control signals previously discussed.

A third embodiment of the invention employs a combination of the first and second embodiments. In this system, the forward vehicles of a sequence of vehicles approaching the merge are detected via the passive reflections of the first embodiment, while the vehicles following thereafter are detected via the repeated signals of the second embodiment.

DESCRIPTION OF THE PREFERRED EMBODIMENTS

Figure 1:
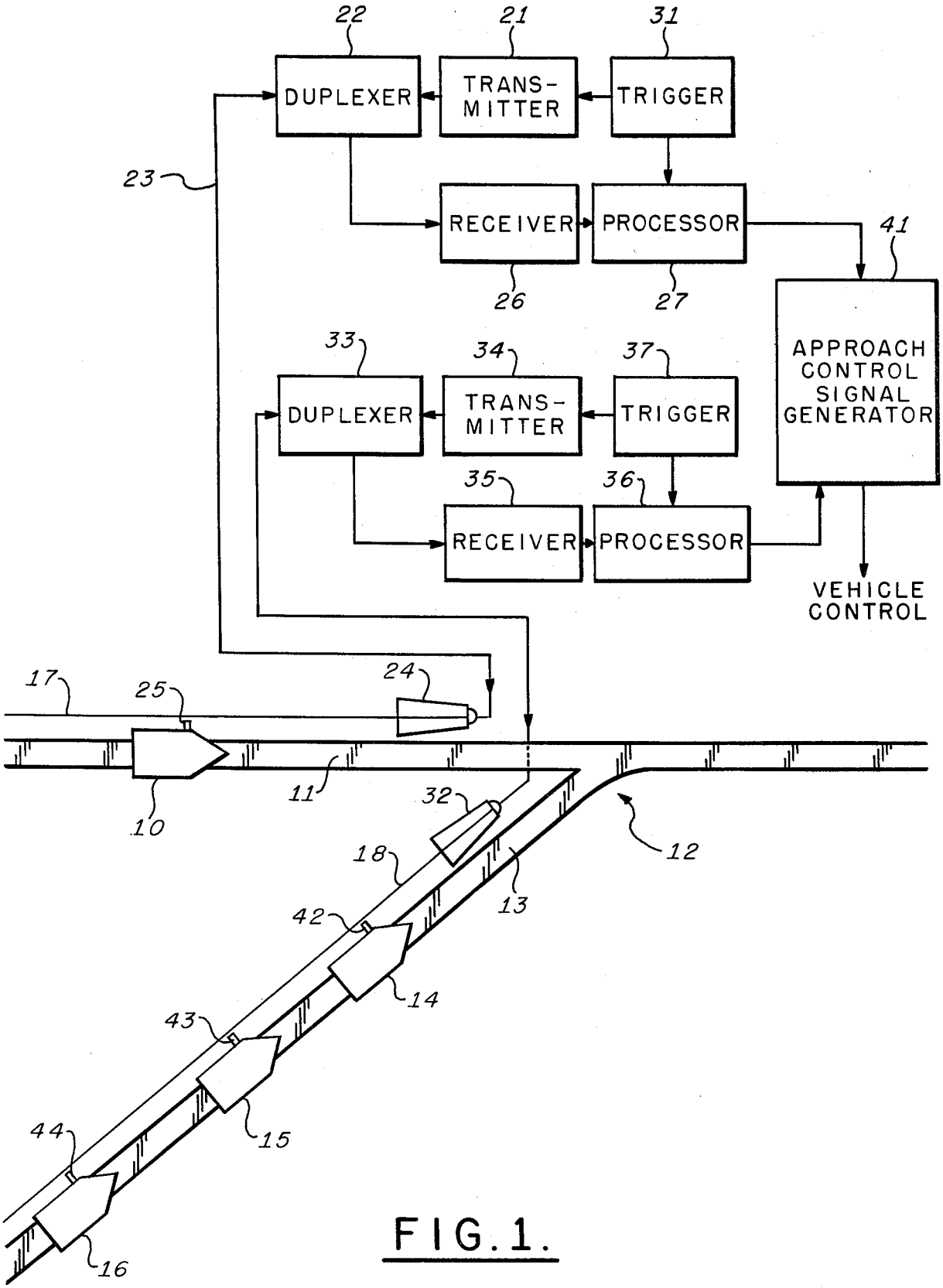
FIG. 1 is a block diagram of a passive vehicular traffic control system for merging guideways.

In FIG. 1, a vehicle 10 travelling along a first guideway (vehicle guiding channel) 11 approaches a merge 12 with a second guideway 13 along which a number of vehicles, as for example, vehicles 14, 15 and 16 are also approaching the merge 12. Positioned parallel to the guideways 11 and 13 are transmission lines 17 and 18, respectively, which may be surface wave transmission lines of the type disclosed by Goubau in U.S. Pat. No. 2,685,068 issued July 27, 1954. A short pulse transmitter 21, which may be of the type described in U.S. Pat. No. 3,832,568 issued Aug. 27, 1974 to Wang and assigned to the assignee of the present application, is coupled via duplexer 22, yet to be described, transmission line 23, and transition unit 24, which may be of the type described in the patent to Goubau, to the transmission line 17. A reflector 25, such as that described in the aforementioned Cronson et al. application and in U.S. Pat. No. 4,188,595 issued Feb. 12, 1980 to Cronson et al. and assigned to the assignee of the present invention, extends from the vehicle to couple to the transmission line 17. Also coupled to the transmission line 17 via transition unit 24 and duplexer 22 is the receiver 26, the output of which is coupled to a processor 27. The transmitter 21 and the processor 27 are coupled to a trigger circuit 31 which provides the activation and reference signals for the system. Similarly, transmission line 18 is coupled via transition unit 32 and duplexer 33 to a transmitter 34 and the receiver 35. The receiver 35 is coupled to a processor 36 which in turn is coupled to a trigger unit 37 that is also coupled to transmitter 34. The processors 27 and 36 each are coupled to approach control signal generator 41 wherein the range and range rates of the vehicles in the guideways 11 and 13 are processed to derive vehicle control signals.

Upon reception of a signal from trigger unit 31, transmitter 21 generates a short pulse of substantially nanosecond duration which is coupled via duplexer 22, transmission line 23, and transition unit 24 to surface wave transmission line 17 to propagate towards the approaching vehicle 10. Upon incidence to the reflector 25 protruding from the vehicle 10, a portion of the pulse energy is reflected back along the surface waveguide to the transition unit 24 wherefrom it is coupled via duplexer 22 to receiver 26, which may be of the type disclosed in U.S. Pat. No. 3,971,990 issued July 27, 1976 to Ross and is assigned to the assignee of the present invention. The reflected signals received at receiver 26 are detected therein and signals representative thereof are coupled to processor 27 wherein signals representative of the range and range rate of vehicle 10 are generated and coupled to approach control signal generator 41.

Short pulses of substantially nanosecond duration emitted from transmitter 34 are coupled via duplexer 33 and transition unit 32 to surface wave transmission line 18 and propagate from transition unit 32 towards the approaching vehicles 14, 15, and 16. This pulse is initially incident to reflector 42 protruding from vehicle 14 whereat a portion thereof is reflected with the reflectivity in the order of −18 dB back towards the transition unit 32. Since surface wave transmission line 18 is not shielded, disturbance of the electromagnetic field about this line created by the reflector 42, causes radiation therefrom thus providing an additional transmission loss which for a −18 dB reflector may be in the order of 1 dB. After this reflection the short pulse continues to propagate along the transmission line 18, being reflected from and transmitted past each reflector to which it is incident, until it is incident to the reflector protruding from the final vehicle of interest. Each of the reflected pulses is coupled from the transmission line 18 via the transition unit 32 and the duplexer 33 to the receiver 35, wherefrom a sequence of pulses representative of the distances of the vehicles 14, 15, and 16 from the transition unit 32 is coupled to processor 36 for the determination of the range and range rate of each of the vehicles. Signals representative of these ranges and range rates are coupled from processor 36 to approach control signal generator 41 wherein they are processed with the range and range rate information from processor 27 to provide vehicular control signals for transmission to the vehicles on guideways 11 and 13.

Figure 2:
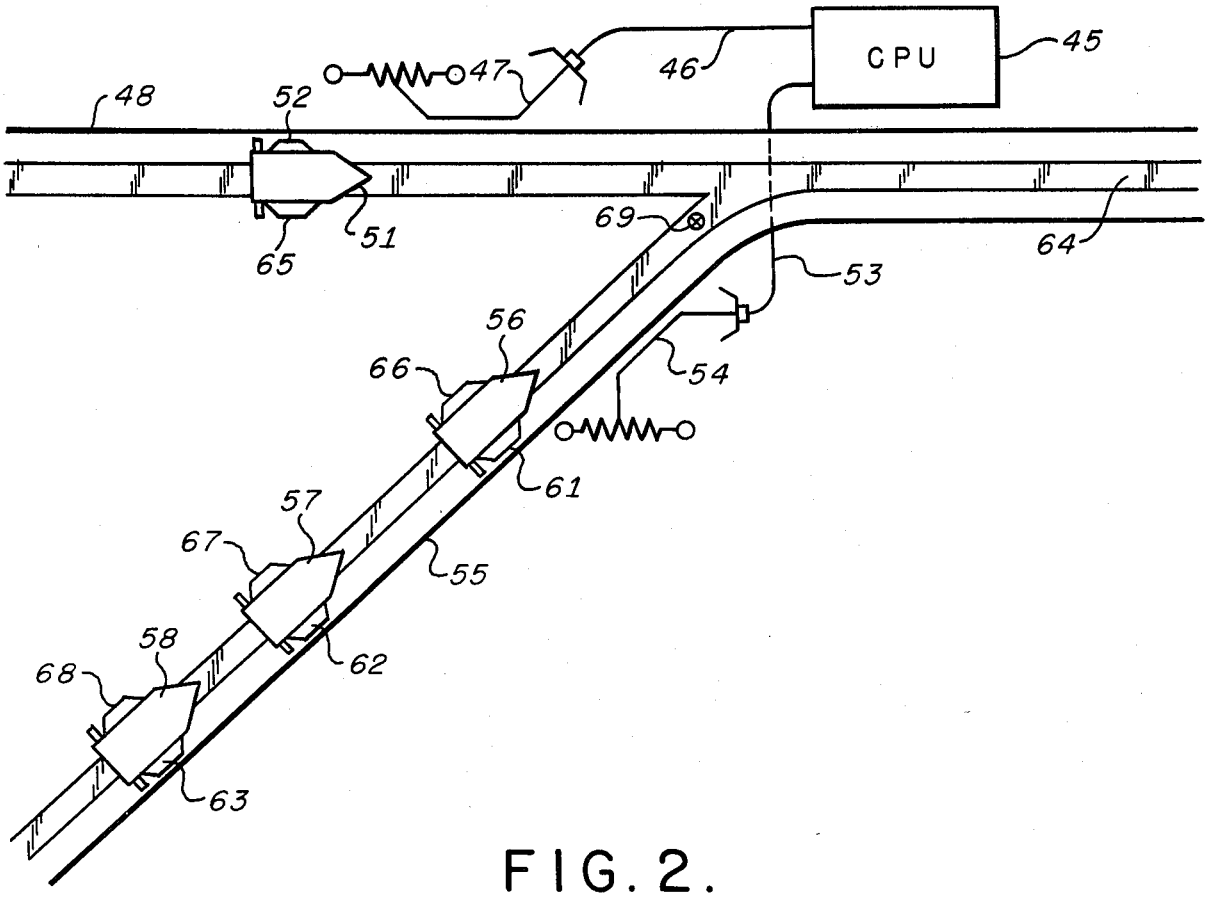
FIG. 2 is an illustration of merging guideways configured with a repeater type vehicular traffic control system.

FIG. 2 depicts a surface wave transmission line and vehicular configuration for a second embodiment of the invention which may be utilized with the aforementioned Cronson et al. invention. The system utilizes a combination of the passive system described above and on-board collision avoidance equipment to establish a semi-active system with built-in redundancy. Redundancy permits the combination system to track vehicles of interest should an on-board reflector or receiver-transmitter fail. Short electromagnetic pulses of substantially nanosecond duration are coupled via transmission line 46 and directional coupler 47 to propagate along a surface wave transmission line 48 away from the merge location towards approaching vehicles as for example, vehicle 51. A directional coupler 52, similar to the directional coupler 47, on board the vehicle 51 couples a portion of the substantially nanosecond pulse energy to an on board repeater, yet to be described. The pulse signal output of the repeater, which is also of substantially nanosecond duration, is coupled via the directional coupler 52 to the transmission line 48 for propagation towards the merge location, where it is coupled via directional coupler 47 and transmission line 46 to central processing unit 45. Similarly, a short pulse of substantially nanosecond duration is coupled from the central processing unit 45 via transmission line 53 and directional coupler 54 to transmission line 55 to propagate towards vehicles approaching the merge location, as for example, vehicles 56, 57, and 58. These short pulses are coupled to repeaters on board vehicles 56, 57, and 58 via directional couplers 61, 62, and 63, respectively, from which short pulses representative of the received pulses are coupled via directional couplers 61, 62, and 63 to surface wave transmission line 55 to propagate towards the merge location, where they are coupled via directional coupler 54 and transmission line 53 to the central processing unit 45. Transmission lines 48 and 55 may both extend beyond the merge to run parallel to the main guideway 64. Each vehicle may be equipped with directional couplers on the side opposite the directional couplers previously introduced, as for example, the couplers 65, 66, 67, and 68 on vehicles 51, 56, 57, and 58, respectively. As the vehicles pass the merge, a switch activator 69 positioned at the merge location may activate a switch on board each vehicle to select one of the couplers, thus determining which transmission line will be utilized for the collision avoidance system along the main guideway 64.

Figure 3:
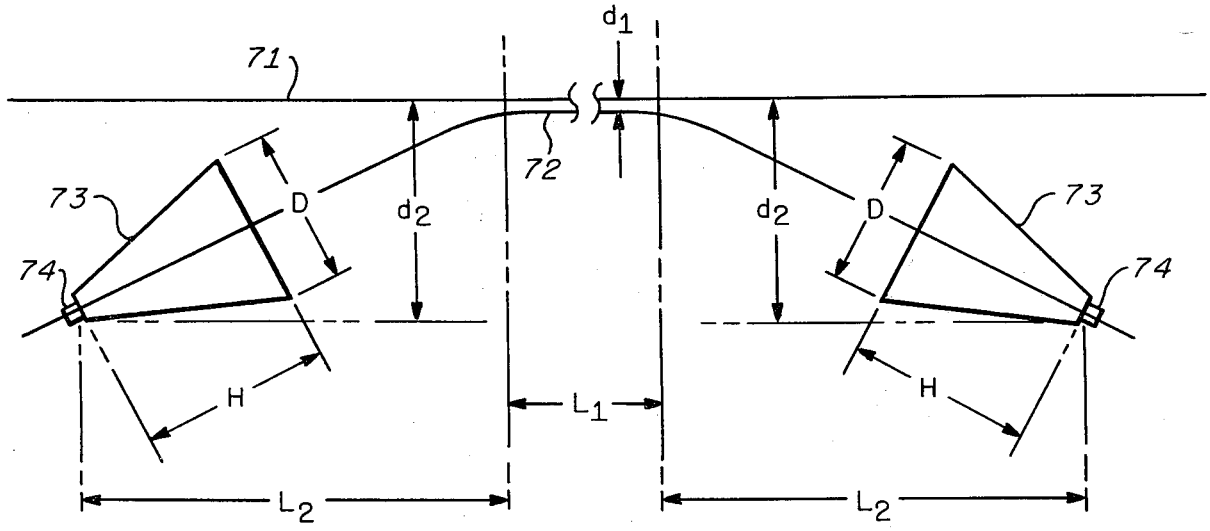
FIG. 3 is a diagrammatic plan view of surface wave transmission line directional coupler.

A directional coupler that may be used on board the vehicles and at the merge location may be constructed as shown in FIG. 3. The surface wave transmission line 71 may comprise a number 10 AWG copper wire, a section of the coupler, which may also comprise number 10 AWG copper wire, extends parallel to the surface wave transmission line 71 for a length $L_1$, which may be in the order of 12 feet with the two copper wires 71, 72 separated by a distance $d_1$, which may be in the order of 1 inch. The copper wire of the coupler 72 uniformly increases its distance from the surface wave transmission line 71 until at a distance $L_2$ which may be in the order of 3 feet 6 inches from the end of the parallel section it is a distance $d_2$, which may be in the order of 14 inches. The transition units 73 may comprise hollow metallic cones with a base diameter D in the order of 8 inches and a cone height H in the order of 12 inches. At the apex of the cone, a type "N" coax connector 74 may be positioned with its inner conductor coupled to the copper conductor 72 and its outer conductor coupled to the metallic cone 73.

Figure 4:
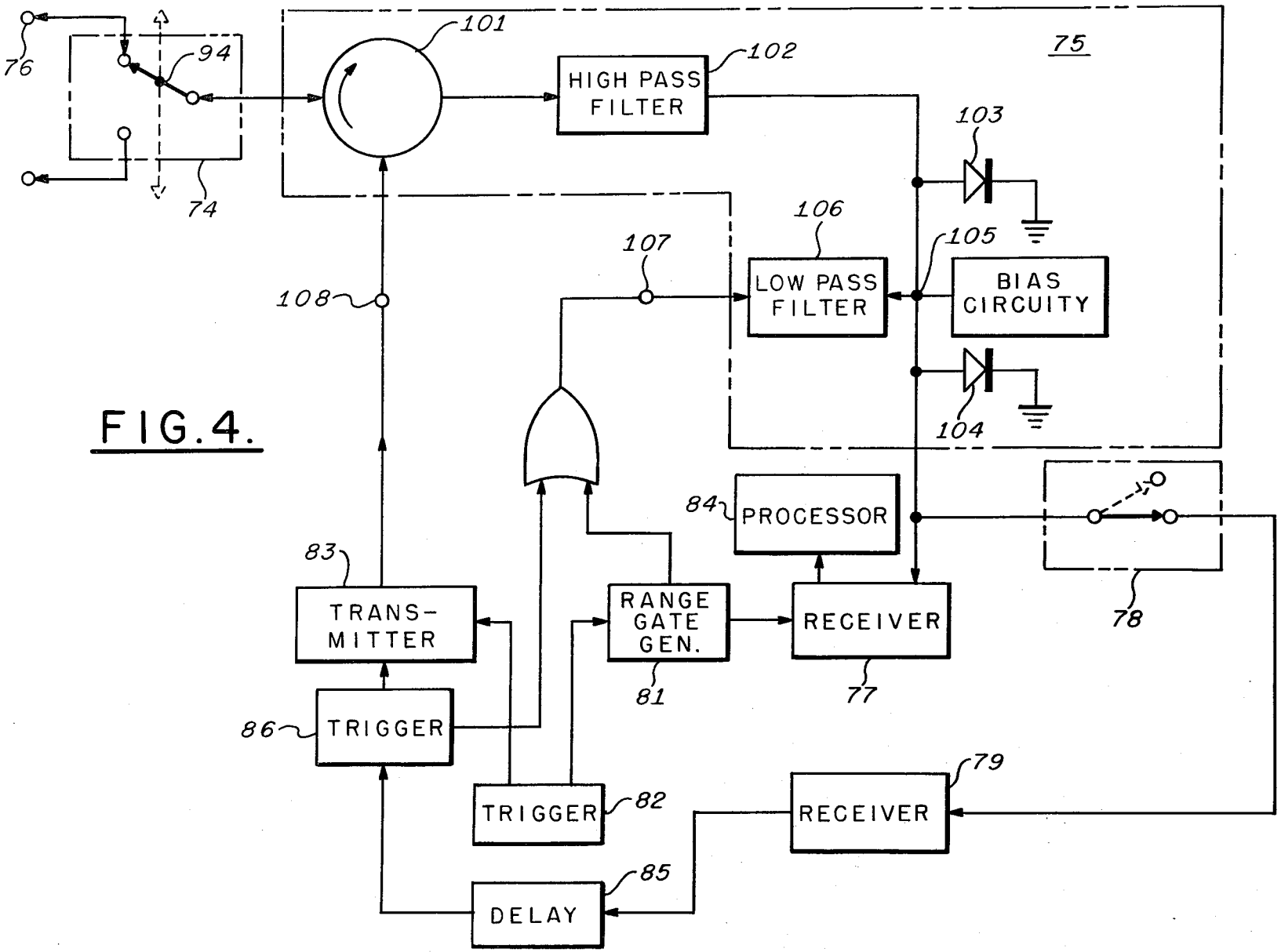
FIG. 4 is a block diagram of an on-board repeater for a vehicular traffic control system.

FIG. 4 depicts a repeater suitable for installation on each of the vehicles that are to be controlled by the system. At the merge location, the position of the switch 74 may be altered by the switch activator 69. With the switch 74 appropriately positioned, the short pulses transmitted from the central processing unit 45 may be coupled to the duplexer 75 via input terminal 76. The output signal from the duplexer 75 will be coupled to a receiver 77 and via switch 78 to a second receiver 79. Receiver 76 is range gated by a range gate generator 81 which is activated by a trigger 82. Trigger 82 is also coupled to transmitter 83 which in turn is coupled via duplexer 75, switch 74, and terminal 76 to the directional coupler for coupling short pulses of substantially nanosecond duration of the surface wave transmission line. Output pulses from receiver 79 are coupled to a second trigger 86, and through a delay 85, the purpose of which is yet to be explained, are also coupled to transmitter 83.

The receiver 77, transmitter 83, and the processor 84, which is coupled to receive signals from the receiver 77, operate as described in the Cronson et al. application. With the switch 78 positioned to couple receiver 79 to the duplexer 75, pulses transmitted from the central processing unit 45 of FIG. 2 cause receiver 79 to couple signals to trigger 86 via delay 85, which in response thereto generates a trigger pulse that is coupled to activate transmitter 83. Pulses from transmitter 83 are coupled via duplexer 75 and the directional coupler to propagate towards the central processing unit. Receiver 79 may be of the general kind described in U.S. Pat. No. 3,662,316 issued May 9, 1972 to Robbins and assigned to the assignee of the present invention. To minimize the effect of the repeater system so established on the operation of the inter-vehicle anti-collision system described by Cronson et al., the pulse repetition frequency (PRF) of the pulses transmitted from the central processing unit may be jittered over a predetermined range, as for example 10%. This jittering avoids synchronization of the pulses transmitted from the vehicle by the transmitter 83 caused by trigger pulses from trigger 82 with the pulses from the transmitter 83 caused by the reception of signals transmitted from the central processing unit.

Figure 5:
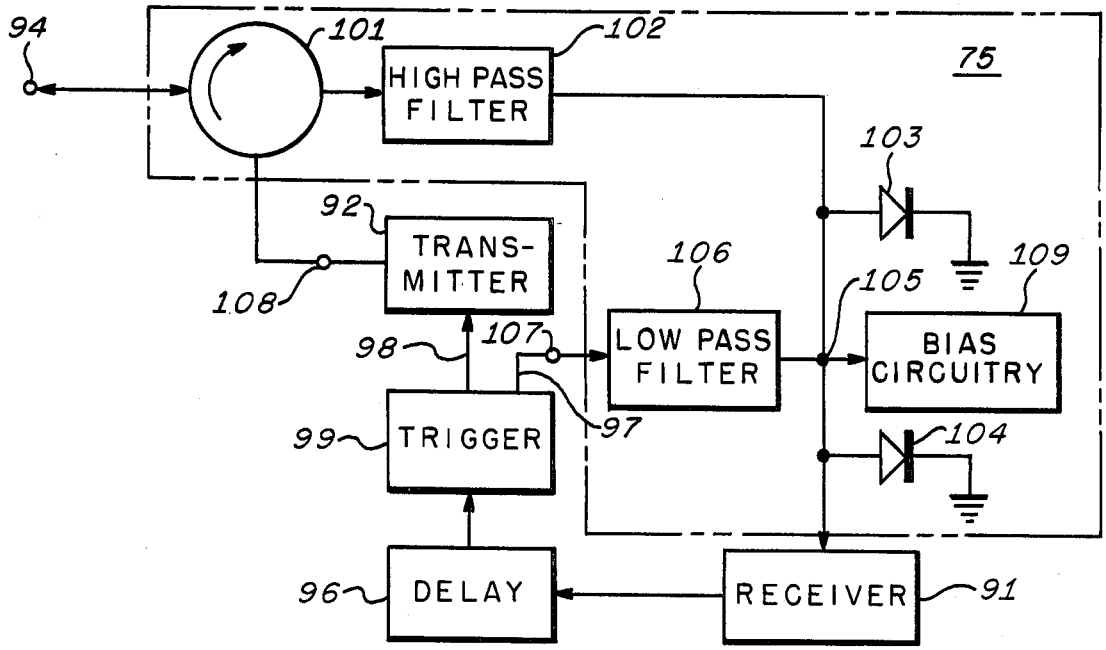
FIG. 5 is a block diagram of a second on-board repeater for a vehicular traffic control system.

The repeater system of FIG. 4 may be realized with a transmitter used exclusively therefor, as shown in FIG. 5. A receiver 91 and transmitter 92 may be coupled via a duplexer 75, which is configured substantially in like manner to that shown in FIG. 4, and a coupling terminal 94 to a surface wave transmission line not shown. The output terminal of the receiver 91 is coupled to a delay circuit 96 and thence to trigger 99 having one output terminal coupled to the duplexer 75 and another output terminal coupled to the activation terminal of the transmitter 92. Short pulses of substantially nanosecond duration transmitted from the central processing unit and received at terminal 94 are coupled via the duplexer 75 to the receiver 91 which provides a pulse representative thereof to delay circuit 96. Delay circuit 96 in turn couples a pulse to the duplexer via trigger 99 for receiver protection via line 97 and, after substantially a pulse width delay, a pulse for transmitter activation to transmitter 92 via line 98.

Referring again to FIGS. 4 and 5, the duplexer 75 which enables the transmitters and receivers to be coupled to a single surface wave transmission line may comprise a circulator 101 with its input terminal coupled to the surface wave transmission line via a directional coupler not shown, a high pass filter 102 coupled to one output terminal of the circulator 101, first and second diodes 103 and 104 coupled between the output terminal of the high pass filter and ground, a bias circuit 109 coupled to the node 105 formed by the diode anode junction, a low pass filter 106 coupled between the node 105 and a duplexer input terminal 107, and an input terminal 108 coupled to an input port of the circulator 101. A short pulse of substantially nanosecond duration containing therewithin substantially two cycles of an r.f. signal is coupled by virtue of the circulating characteristics of the circulator 101 to high pass filter 102 wherefrom it is coupled to the node 105. When the transmitters 83 in FIG. 4 and 92 in FIG. 5 are in a non-transmitting condition, the bias coupled to node 105 from bias circuitry 109, trigger 86 and range gate 81, or trigger 99 is such as to maintain the diodes 103 and 104 in the off condition, thus permitting signals from the high pass filter 102 to be coupled to receivers 77 and 79. When the transmitter 83 in FIG. 4 is activated by the trigger 82, a range gate is coupled from range gate generator 81 to receiver 77 and, just prior to the generation of a transmitted pulse, a signal is coupled via low pass filter 106 to node 105 which causes the diodes 103 and 104 to conduct thus shorting node 105 to ground. This prevents any leakage of the transmitted pulse from the transmitter input terminal of circulator 101 to the receiver output terminal that is coupled through high pass filter 102 from entering the receivers 77 or 79. Similarly, after the reception of a pulse from the central processing unit, receiver 79 couples a pulse via delay line 85 to trigger 86 which in turn activates transmitter 83 and just prior to the coupling of the pulse of transmitter 83, a signal is coupled via low pass filter 106 to node 105 to create the short circuit previously described. The range gate generated by range gate generator 81 is in synchronism with trigger 82. Since the signals transmitted from the central processing unit are jittered, pulses transmitted by transmitter 83 due to trigger 86 are not in synchronism with trigger 82. Thus signals received by receiver 77 from the central processing unit are spread over a multiplicity of range cells within the over-all range gate and have a minimal effect on the range determination of the anti-collision system.

Figure 6:
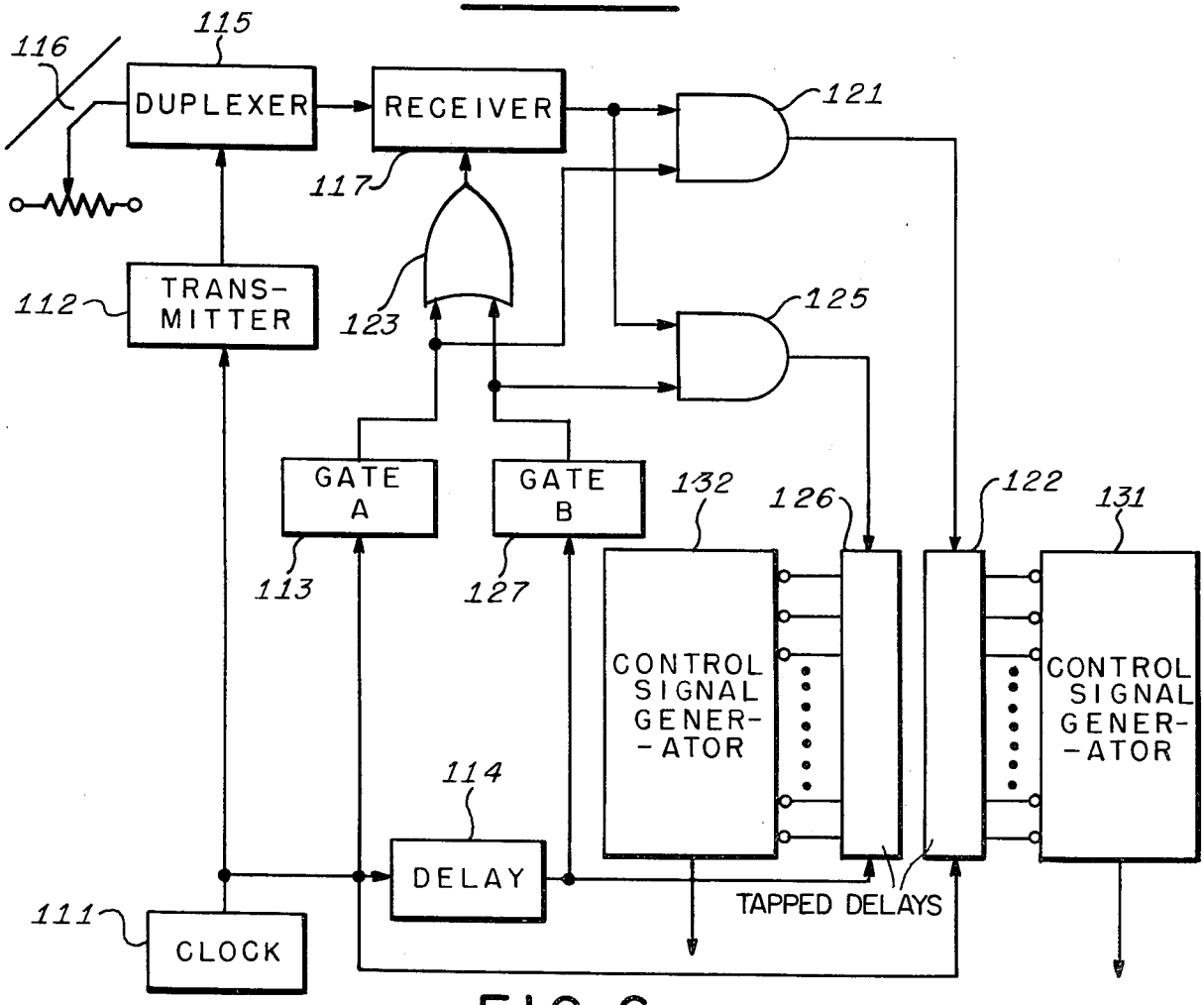
FIG. 6 is a block diagram of a ranging system for an active-passive vehicular traffic control system.

Two vehicular control systems have thus far been described, a passive system and an active system. A third system, one integrating the passive and active systems may be implemented. In this combination system, vehicular and guideway configurations may be as shown in FIG. 2. System losses may be such that signals reflected from the leading vehicles of a series approaching the merge may be of sufficient strength to allow the implementation of a passive system, while reflections from vehicles further down the guideway may not exhibit such signal strength. To insure sufficient signal strength from the vehicles further down the guideway, the repeater system may be required. To implement such a combination system, the circuitry shown in block form in FIG. 6 may be included in the central processing unit. A clock 111 may be coupled to a transmitter 112, a gate 113, and a delay line 114. The output terminal of the transmitter may be coupled via a duplexer 115 to a directional coupler 116 which is also coupled via the duplexer 115 to receiver 117. The output terminal of receiver 117 is coupled to one input terminal of AND gate 121, the output terminal of which is coupled to the input terminal of a tapped delay line 122, which may be of the type described in U.S. Pat. No. 3,979,749, issued Sept. 7, 1976 to Ross and assigned to the assignee of the present invention, while a second input terminal of the tapped delay line 122 may be coupled to the output terminal of clock 111. The output terminal of gate 113 is coupled to one input terminal of an OR gate 123 and to the second input terminal of AND gate 121. A second AND gate 125 has an input terminal coupled to the output terminal of receiver 117 and its output terminal coupled to an input terminal of a second tapped delay line 126, a second input terminal of which is coupled to the output terminal of the delay line 114. Also coupled to the output terminal of delay line 114 is the input terminal of a second gate 127 having its output terminal coupled to a second input terminal of OR gate 123 and a second input terminal of AND gate 125. With each clock pulse generated by clock 111, a pulse is emitted from transmitter 112 and coupled via duplexer 115 and directional coupler 116 to a surface wave transmission line along which it propagates until it is reflected from a reflector on a leading vehicle or repeated from the repeater on board a vehicle further down the guideway. Gate 113 enables receiver 117 via OR gate 123 and simultaneously enables AND gate 121. A reflected pulse from one of the leading vehicles is coupled via directional coupler 116 and duplexer 115 to a receiver 117 which couples a pulse representative thereof to AND gate 121, which when enabled by gate 113, couples a pulse representative of the pulse from receiver 117 to the first terminal of tapped delay line 122, the second input terminal of which has previously received the initiating clock pulse. These two pulses propagate along the tapped delay line 122 to determine the range to the reflecting target as described in U.S. Pat. No. 3,979,749. This range information is then coupled to a control signal generator 131 wherein it is processed and a vehicle control signal derived therefrom. Since AND gate 121 is disabled at the conclusion of the signal from gate 113, all signals subsequently received are prohibited from entering tapped delay line 122.

Each pulse from clock 111 is also coupled via delay 114 to the second input terminal of the tapped delay line 126 and to gate 127 wherein, at its reception a gate signal is coupled to the second input terminal of AND gate 125 and via OR gate 123 to receiver 117. The delay in delay line 114 is selected such that all reflected signals received from the leading vehicles arrive at a time prior to the generation of the delayed range gate, thus preventing signals at the output terminal of receiver 117 resulting from the reception of these reflected signals from being coupled through AND gate 125 to a first input terminal of the tapped delay line 126. Thus, the signals coupled to the first input terminal of the tapped delay line 126 during the existence of the delayed gate are those emanating from the vehicles further down the guideway. These signals are generally those generated by the on-board repeater, since it is assumed that the losses of the system would prevent the reflected signals from having sufficient strength to be detected by the receiver 117. The signal strength of the reflected signal, however, for vehicles at a distance from the directional coupler corresponding to the leading edge of the delayed range gate, may be of sufficient strength for detection. To isolate these reflected signals from the repeater signals, the on-board delay 85 in FIG. 4 and 96 in FIG. 5 may be included and the delay of delay line 114 increased by this time interval. The signals received by receiver 117 during the time interval of the delayed gate from gate 127 is coupled via AND gate 125 to the first input terminal of the tapped delay line 126 wherein the range to the repeating vehicle is determined and coupled to the control signal generator 132 wherein it is processed and a vehicle control signal is generated.

While the invention has been described in its preferred embodiments, it is to be understood that the words which have been used are words of description rather than of limitation and that changes within the purview of the appended claims may be made without departure from the true scope and spirit of the invention in its broader aspects.

I claim:

1. A system for determining distance to and speed of vehicles travelling in each of a multiplicity of merging guideways comprising:

means paralleling each of said merging guideways for the propagation of short electromagnetic pulses;

means coupled to said propagation means at a fixed preselected location for generating first electromagnetic pulses of short duration;

means on board each of said vehicles responsive to said first electromagnetic pulses for coupling second electromagnetic pulses of short duration to said propagation means for transmission towards said fixed location;

means coupled to said propagation means substantially at said preselected location for receiving said second electromagnetic pulses and for providing signals representative thereof; and means coupled to receive said representative signals for determining distances from said fixed location to and speed of a preselected number of said vehicles.

2. A system in accordance with claim 1 wherein said response means includes means positioned on board said vehicles for reflecting said first electromagnetic pulses incident thereto, said reflecting means so configured and located relative to said propagation means as to permit a portion of each of said first electromagnetic pulses coupled to said propagation means to propagate therepast such that reflections from a reflector on an $n^{th}$ vehicle, a predetermined number of vehicles from said fixed preselected location, are returned to said preselected location with sufficient amplitude for detection.

3. A system in accordance with claim 1 or 2 further including duplexing means at said fixed location coupled to said propagation means, said fixed location generating means, and said fixed location receiving means for coupling said first electromagnetic pulses to said propagation means and for coupling said second electromagnetic pulses to said receiving means while said fixed location generating means and said fixed location receiving means are maintained substantially decoupled.

4. A system in accordance with claim 1 or 2 wherein said response means includes:

means, on board each of said multiplicity of vehicles, for generating electromagnetic pulses of short duration;

means on board each of said multiplicity of vehicles for receiving electromagnetic pulses of short duration and for providing activating signals to said on-board generating means in response thereto; and means on board each of said multiplicity of vehicles coupled to said on-board generating means, said on board receiving means, and said propagation means for coupling electromagnetic pulses to said on-board receiving means in response to said first electromagnetic pulses and for coupling said second electromagnetic pulses to said propagation means in response to electromagnetic pulses from said on-board generating means.

5. A system in accordance with claim 4 further including on-board duplexer means coupled to said on-board coupler means, said on-board generating means, and said on-board receiving means for coupling electromagnetic pulses from said on-board generating means to said on-board coupler means and electromagnetic pulses from said on-board coupler means to said on-board receiver means while maintaining isolation between said on-board generating means and said on-board receiver means.

6. A system in accordance with claim 4 further including delay means coupled between said on-board receiving means and said on-board generating means for providing a preselected time delay between said first electromagnetic pulse received from said fixed location generating means and said activating signal coupled to said on-board generating means.

7. A system in accordance with claim 6 further including:

duplexer means coupled at said fixed preselected location to said propagation means, said fixed location generating means, and said fixed location receiving means for coupling said fixed location generating means and said fixed location receiving means to said propagation means while maintaining decoupling between said fixed location generating means and said fixed location receiving means;

clock means coupled to said fixed location generating means and said distance and speed determining means for providing activating signals to said fixed location generating means and distance reference signals to said distance and speed determining means;

first and second gate means coupled to said clock means for providing first and second gate signals respectively in response to said activating signals;

delay means having an input terminal coupled to said clock means and an output terminal coupled to said second gate means and said distance and speed determining means for providing a preselected time interval between said generation of said activating signals and reception of said activating signals by said second gate means and for providing said time interval between said generation of said activating signals and reference signals to said distance and speed determining means;

OR gate means coupled to said first and second gate means and said receiving means for providing a gate signal to said receiving means in response to gate signals provided by said first or second gate means;

first AND gate means coupled to said fixed location receiver means to receive said representative signal and to said first gate means to receive said first gate signal, said first AND gate means having an output terminal coupled to said distance and speed determining means for providing a signal thereto during the simultaneous existence of said representative signal and said first gate signal; and second AND gate means coupled to said fixed location receiver means to receive said representative signal and to said second gate means to receive said first gate signal, said second and gate means having an output terminal coupled to said distance and speed determining means for providing a signal thereto during the simultaneous existence of said representative signal and said second gate signal.

8. A method for determining distance to and speed of vehicular traffic approaching a merge of a multiplicity of channels which comprises:

transmitting first electromagnetic pulses of short duration from a fixed location near said merge along propagation means to be incident to vehicles in each of said channels approaching said merge;

providing on each of said vehicles means for returning second electromagnetic pulses of short duration towards said fixed location that are representative of said first electromagnetic pulses of short duration;

positioning said pulse returning means on said vehicles relative to said propagation means such that portions of said first electromagnetic pulses of short duration propagate therepast to be incident to following vehicles;

receiving said second electromagnetic pulses of short duration at said fixed location; and processing said second electromagnetic pulses to provide distances to and speed of said vehicles approaching said merge.

* * * * *